US005238249A

United States Patent [19]

Elias et al.

[11] Patent Number: 5,238,249

[45] Date of Patent: Aug. 24, 1993

[54] DICE SIMULATOR

[76] Inventors: Stephen L. Elias, 43 Aldercrest Dr., Nepean, Ontario, Canada, K2G 1R2; Robert B. Vanstone, 49 Langdon Rd., London, Ontario, Canada, N5V 2L9

[21] Appl. No.: 692,383

[22] Filed: Apr. 29, 1991

[30] Foreign Application Priority Data

Feb. 11, 1991 [CA] Canada ..... 2036119

[51] Int. Cl.[5] ..... A63F 9/24; A63F 9/04

[52] U.S. Cl. ..... 273/138 A; 273/148 R; 273/146

[58] Field of Search ..... 273/138 A, 146, 85 LP, 273/148 R; 364/410, 412, 411, 717

[56] References Cited

U.S. PATENT DOCUMENTS 4,431,189 2/1984 Wiencek et al. ..... 273/138 A
4,692,863 9/1987 Moosz ..... 273/138 A
4,819,818 4/1989 Simkus et al. ..... 273/138 A
4,858,122 8/1989 Kreisner ..... 273/138 A
4,909,513 3/1990 Kiyono ..... 273/138 A

FOREIGN PATENT DOCUMENTS 0061052 9/1982 European Pat. Off. ..... 273/138 A

OTHER PUBLICATIONS

Hacker, Dr. M. J., "Heads-Tails Indicator with Variable Probability", *Practical Electronics*, vol. 12, No. 9, p. 746, Sep. 1976.

*Primary Examiner*—Jessica J. Harrison
*Attorney, Agent, or Firm*—David Newman & Associates

[57] ABSTRACT

A dice simulator for simulating dice rolling or the like utilizes operator selectable probability weighting to cause quasi-random rolling results to be biased in accordance with the selected probability weighing.

14 Claims, 7 Drawing Sheets

DICE SIMULATOR

BACKGROUND OF THE INVENTION

1. Field of the Invention

This invention pertains to random/pseudo-random number generators and particularly to electronic dice simulators to provide displays of numbers in specified ranges.

2. Description of the Related Art

Prior art electronic dice simulators include those disclosed in U.S. Pat. No. 4,819,818 granted Apr. 11, 1989 to Simkus et al, and U.S. Pat. No. 4,432,189 granted Feb. 14, 1984 to Wiencek et al.

Simkus et al provides a micro-computer driven random data selection system wherein a processor is arranged to read a matrix of switches to determine a range of numbers and to establish a software controlled sequencing routine corresponding to that range. The interrupt terminal of the micro-computer is used to sense the activation of the system and cause the number selection. The software of the Simkus device presents the internal counters to the requisite range in response to the status of the switch matrix and displays that range in one of the two LED displays. Following sensing of the range, the computer starts the sequencing or counting and continuously sequences until deactivated. When the "roll" switch is operated, the computer samples and displays the last number in the sequence. Data for controlling the displays and loading the counter is stored in memory locations and the address for this data is developed from an index generated from the switch matrix inputs.

Wiencek et al provide a circuit in a device for electronically determining a simulated roll of a six-sided die (or two-sided dice). The circuit consists of a multi-position switch and related circuitry which allows the device to also simulate a roll of a die other than six-sided, namely four-sided, eight-sided, twelve-sided, twenty-sided or one hundred-sided.

The above mentioned prior art devices have the drawback of allowing only one or two dice to be thrown at one time. Moreover, prior art dice simulators have generally not provided one or more random or pseudo-random numbers from an unlisted range. Nor have they allowed for operators to weight the probability of "rolling" either a high number or a low number.

SUMMARY OF THE INVENTION

The present invention provides apparatus for simulating dice rolling or the like, comprising: first data entry means for entering numerical selection data; microprocessor means for processing said numerical selection data and computing, in a predetermined, quasi-random manner, results corresponding to the selected numerical data; and second data entry means for entering probability weighting criteria to bias said computing in a predetermined quasi-random manner and cause the processing of the numerical selector data to yield simulation results in accord with said probability weighting criteria.

In a narrower aspect of the invention further provides duplicated display means to permit simulation results to be viewed by other users, as well as the operator.

BRIEF DESCRIPTION OF THE DRAWINGS

The preferred embodiment of the invention will now be described with reference to the annexed drawings, in which.

DESCRIPTION OF THE PREFERRED EMBODIMENT

Figure 1:
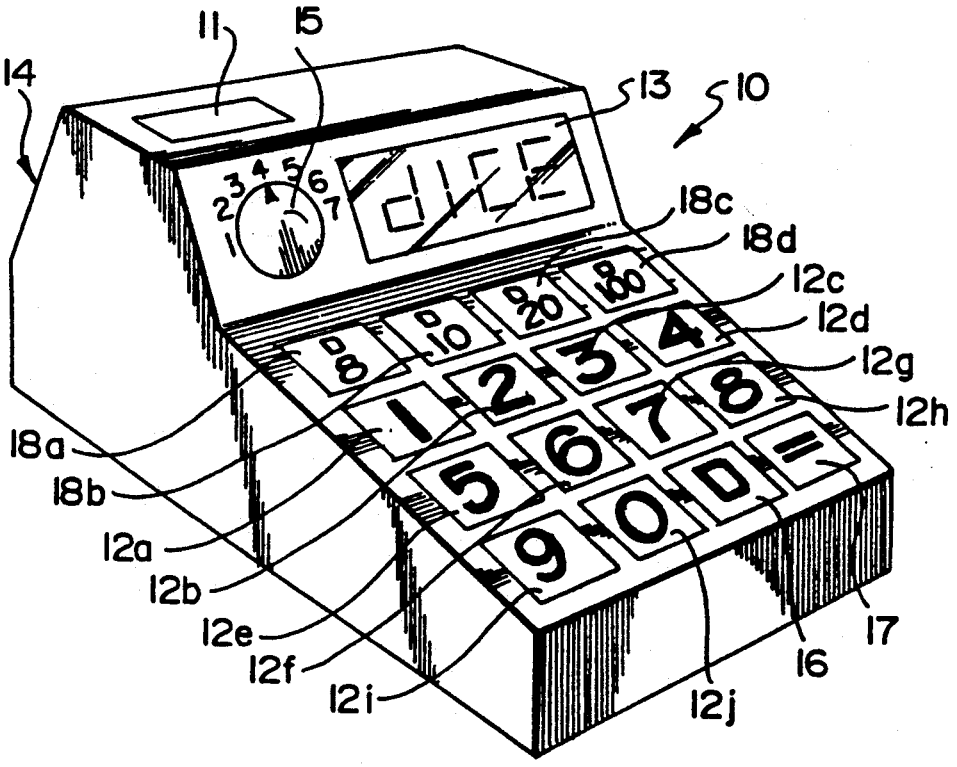
FIG. 1 is a perspective view of a dice simulator according to the present invention.

Referring to FIG. 1, a dice simulator 10 comprises an on/off button 11, numerical key pad buttons 12*a*–12*j* corresponding to the digits 0 to 9, an operator's display 13, a display 14 for other users, a probability weighting dial 15, non-numeric key pad buttons 16 and 17, and four pre-set "dice type" buttons 18*a* to 18*d*.

Figure 2:
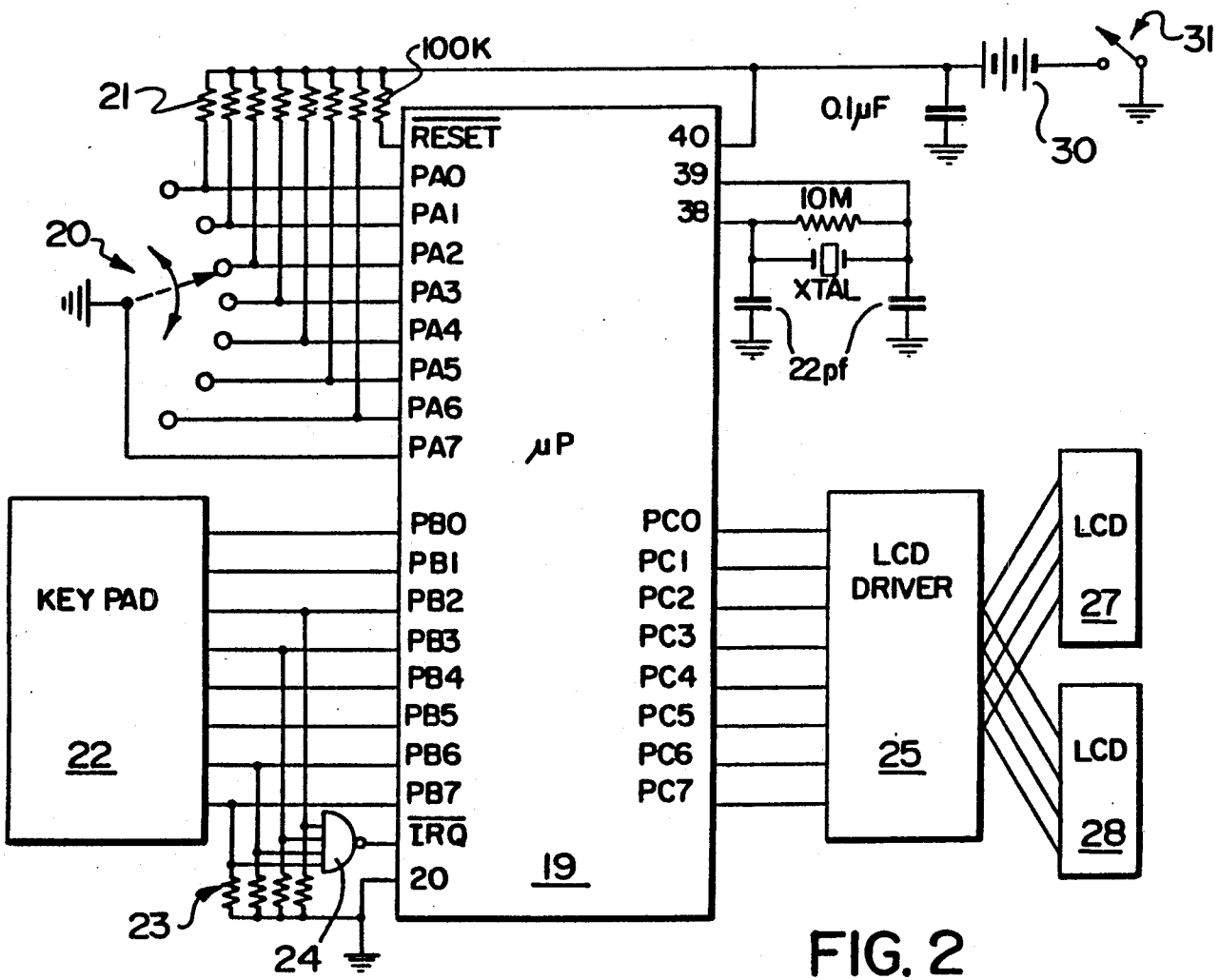
FIG. 2 is a block schematic diagram of the circuit of the dice simulator of FIG. 1.

Referring now to FIG. 2, circuit of the dice simulator 10 comprises a microprocessor 19 (preferably a Motorola MC68HC705) which is connected via its PORT A to a probability weighting selector 20. The microprocessor 19 includes an internal clock, at least one memory, at least one register, and at least one arithmetic-logic unit. The at least one register includes an accumulator as well as variables or storage spaces, which may be included in the at least one memory. The at least one register may serve as counters and as variables in operation. The microprocessor 19 is more fully described in the 1989 Motorola Inc. Semiconductor publication BR594/D, which is incorporated herein by reference. The selector 20 is a seven position switch, each of which is connected to the first seven pins while the wiper of which is connected to the eighth pin of the PORT A and to circuit ground. The position of the switch 20 determining the probability weighting implemented using the dial 15 (FIG. 1). For each position a corresponding line is connected to a corresponding pin in the PORT A. The terminals of the switch 20 are each connected to a logic "high" through respective 1 kOhm resistors referred to generally by the number 21 in FIG. 2. This configuration results in the seven first pins of PORT A being logically high, unless grounded by the wiper of the switch 20. The system software interrogates the pins of PORT A to determine which switch 20 position is selected and to apply the predetermined probability weighting, assigned to the selected position.

A key pad 22 is connected to the pins of PORT B of the microprocessor 19 by eight lines. Four of those lines are for input to the microprocessor 19 and four are for output from it. The four input lines are connected to ground through respective 10 kOhm resistors referred to generally by the number 23 in FIG. 2. As a result of that configuration the output lines are kept high. Depressing a key on key pad 22 causes a corresponding input line to go "high". The input lines between the key pad 22 and microprocessor 19 are also connected to the IRQ pin of the microprocessor 19 through a four input NAND gate 24. The IRQ pin provides two different choices of interrupting triggering sensitivity. As a result, pressing a key on the key pad 22 causes the microprocessor 19 to search the input lines and identify the pressed key.

PORT C of the microprocessor 19 is connected to an L.C.D. driver 25 by eight lines designated generally by reference number 26 in the figure. Four of the lines 26 transmit the number that is to be displayed. The other four lines indicate which digit of the L.C.D. receives the incoming number and signals the L.C.D. to display. Either of the Intersil 7211 or 7211M devices may be used in accordance with manufacturer's specifications.

The L.C.D. driver 25 drives two conventional LCD displays in parallel, one LCD display 27, corresponding to display 13 in FIG. 1, for the operator, and the other LCD display 28, corresponding to display 14 in FIG. 1 for viewers on the other side.

Figure 3A:
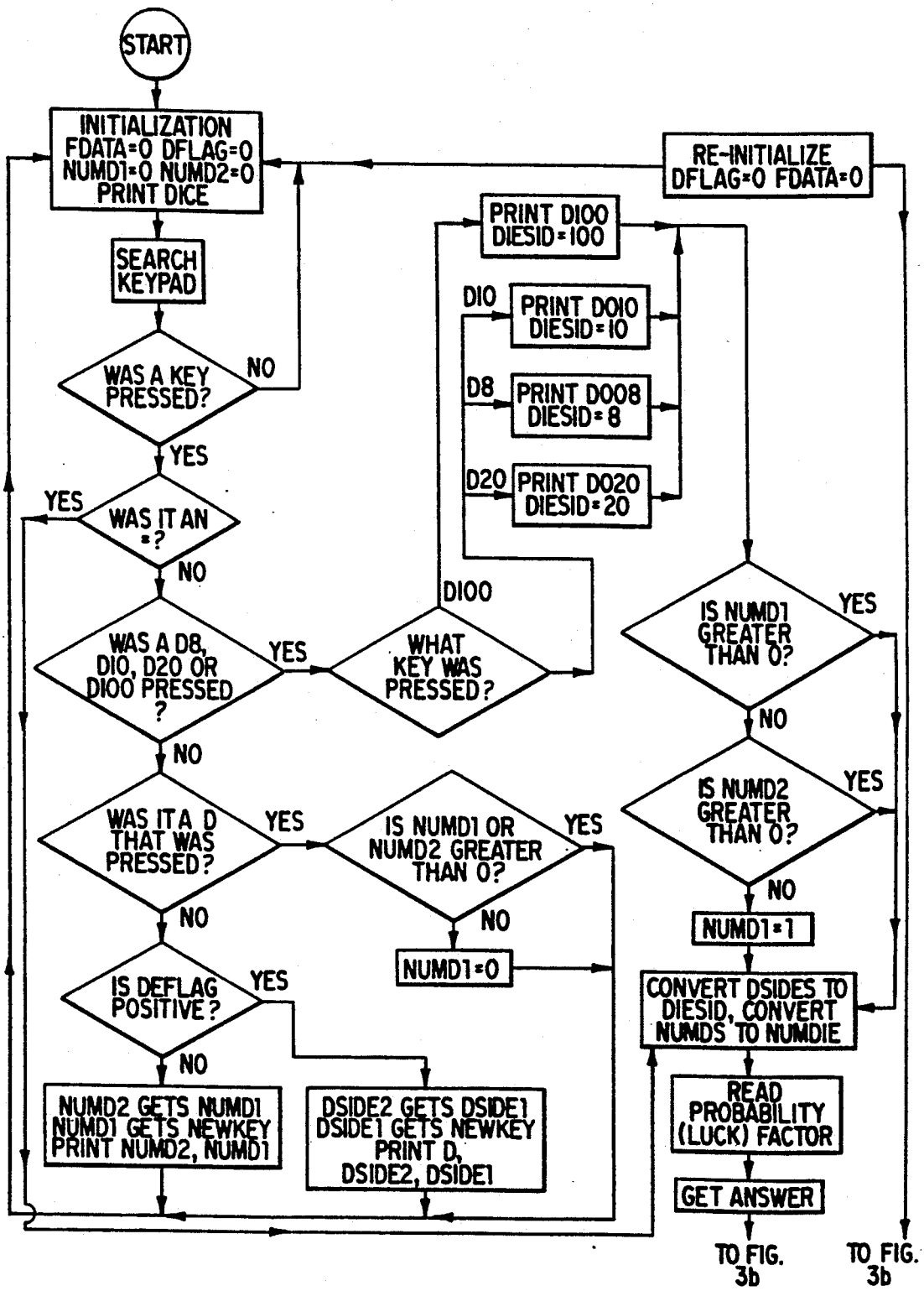
FIGS. 3*a* and 3*b* are the flowchart of the software for operating the circuit shown in FIG. 1.
Figure 3B:
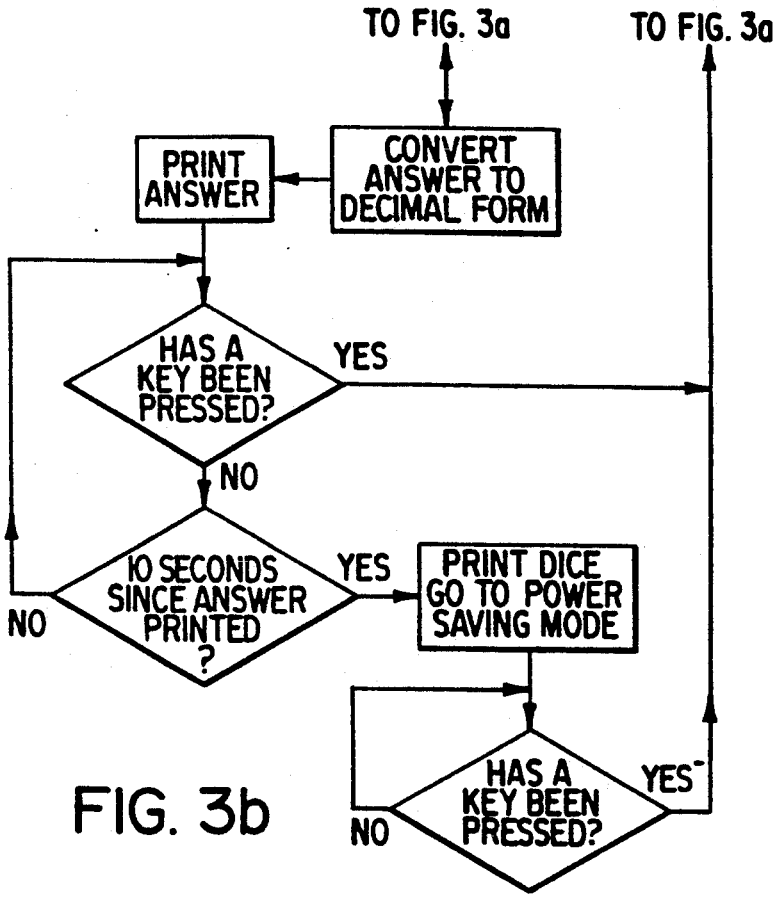

Referring to FIGS. 3*a* and 3*b* once the on/off button 11 (FIG. 1) is used to close the main switch 31 to the buttons 30 the software "starts" by initializing the dice simulator 10 and displays the word "dICE" on the displays 13 and 14. After initialization, the software proceeds according to the flowchart of FIGS. 3*a* and 3*b*. For example, the next step is "search keypad", where the lines from PORT B of the microprocessor 19 to the key pad 22 are searched until the operator pushes a key on the key pad 22.

The main system software shown in FIGS. 3*a* and 3*b* is written in Motorola Assembly Language, and, in machine code form, operates on the at least one memory, the at least one register, and the at least one arithmetic-logic unit of the microprocessor 19. The program corresponding to FIGS. 3*a* and 3*b* is given below in segments preceded and annotated by the customary explanatory commentary in English.

```
        ORG   $1FFE    The Reset vector is located at $1FFE and
        FCB   #$01     $1FFF. This sets the Reset vector to $0100
        FCB   #$00     which is where the program starts.
PORTA   EQU   $00      All inputs - captures LUCK factor
PORTB   EQU   $01      Keypad interface
PORTC   EQU   $02      All outputs - to the LCD
DDRA    EQU   $04      Data direction PORTA
DDRB    EQU   $05      Data direction PORTB
DDRC    EQU   $06      Data direction PORTC
FDATA   EQU   $60      Flag to proceed to ANSWER
DFLAG   EQU   $61      Flag when a D is pressed
PNUM1   EQU   $62      Storage words for
PNUM2   EQU   $63      what is printed
PNUM3   EQU   $64      to the LCD
PNUM4   EQU   $65      4 in all
NUMD1   EQU   $66      One's digit for number of dice rolled
NUMD2   EQU   $67      Ten's digit for number of dice rolled
DSIDE1  EQU   $68      One's digit for the sides on the dice
DSIDE2  EQU   $69      Ten's digit for the sides on the dice
DSIDE3  EQU   $6A      Hundred's digit for the dice sides
DIESID  EQU   $6B      Binary equivalent of DSIDES 1,2,3
PRSKEY  EQU   $6C      Value received from the keypad
LUCK    EQU   $6D      Luck factor
TOTALL  EQU   $6E      Lower word of total rolled on dice
TOTALH  EQU   $6F      Higher word of total rolled on dice
TIMEH   EQU   $70      Higher word of time read from clock
TIMEL   EQU   $71      Lower word of time read from clock
FOUND   EQU   $72      Flag that's true when answer is found
ROLL    EQU   $73      Roll of the individual die
ROLL1   EQU   $74      Test variable in LUCK4
ROLL2   EQU   $75      Test variable in LUCK4
NUMDIE  EQU   $76      Binary form of number of dice
NUMDIC  EQU   $77      Storage form for NUMDIE
DICSID  EQU   $78      Storage form for DIESID
TSTEQ   EQU   $79      Test for an equal sign for repeating
```

The main system program clears and initializes the necessary variables before starting the subroutine calls. Once a key is found and identified, a check is made to ensure that the needed data is available. It the needed data is not available, the keypad is scanned again, until the needed info is obtained. With the info and more data that is obtained in further subroutines, the answer is returned, converted to decimal and then printed out. The flags are then set back to false and the keypad scanned for the next question.

```
        ORG   $100     Program starts at $0100
        CLRA
        STA   DDRA     Set up PORTA as all inputs (LUCK factor)
        LDA   #$99     PORTB is set up as half inputs and half
        STA   DDRB     outputs
        LDA   #$FF
        STA   PORTC    PORTC is all outputs (LCD) and this
        STA   DDRC     turns them on.
        JSR   PDICE    Print dice in the display
        JSR   INIT1    Clear flags, initialize variables
FALSE   JSR   SRCHKY   Get a key from the keypad
        LDA   TST      Is this the first pass through?
        CMP   #$00     If no, skip the next part
        BNE   USUAL    If yes then test for an equal sign
        LDA   PRSKEY   If not, continue as usual
        CMP   #$0F     If yes, then prepare to repeat the
        BNE   USUAL    past roll of the dice
        LDA   NUMDIC   First put the number of dice rolled
```

-continued

| | | | |
|---|---|---|---|
| | STA | NUMDIE | into NUMDIE |
| | LDA | DICSID | Then put the sides of the dice into |
| | STA | DIESID | DIESID |
| | BRA | GTLK | Now skip to the calculation part |
| USUAL | INC | TST | Inc TST to show we've been through |
| | JSR | SRTKEY | Identify key and act accordingly |
| | LDA | #$01 | Test to see if Found is true (if we |
| | CMP | FDATA | the needed data). If not go back and |
| | BNE | FALSE | get more. If yes, continue on |
| | JSR | CONVRT | Convert DSIDEs to DIESID |
| GTLK | JSR | GTLUCK | Get luck factor for answer to use |
| | JSR | ANSWER | Get the answer |
| | JSR | TODEC | Convert the answer to decimal form |
| | JSR | PRNT4 | Print the answer |
| | JSR | INIT1 | Clear the flags and reset to zero |
| | JSR | TMFRDC | This displays the answer for 10 seconds |
| | JSR | PDICE | then prints dice. |
| | BRA | FALSE | Scan for the next question |

The following subroutine clears FDATA, DFLAG, NUMD1 and NUMD2.

| | | |
|---|---|---|
| INIT1 | CLRA | |
| | STA | FDATA |
| | STA | DFLAG |
| | STA | NUMD1 |
| | STA | NUMD2 |
| | STA | TST |

-continued

| |
|---|
| RTS |

The following subroutine scans the keyboard until a key is depressed. It then identifies the key and sends it to the main program as PRSKEY.

| | | | |
|---|---|---|---|
| SRCHKY | LDA | #$99 | |
| | STA | PORTB | |
| | STA | DDRB | Turn on all columns |
| ANYKEY | LDA | PORTB | |
| | AND | #$66 | Mask away columns |
| | BEQ | ANYKEY | |
| | LDA | #$20 | |
| OUTLP | CLRX | | |
| INRLP | DECX | | |
| | BNE | INRLP | |
| | DECA | | |
| | BNE | OUTLP | |
| | CLRX | | |
| KEYLP | LDA | KYTBL,X | |
| | STA | PORTB | |
| | CMP | PORTB | |
| | BEQ | KEYFND | |
| | INCX | | |
| | TXA | | |
| | CMP | #$10 | |
| | BEQ | SRCHKY | |
| | BRA | KEYLP | |
| KEYFND | TXA | | |
| | STA | PRSKEY | |
| TILRLS | LDA | PORTB | This part ensures against people |
| | AND | #$66 | who leave their finger on the |
| | BNE | TILRLS | button. It delays until released |
| | LDA | #$99 | |
| | STA | PORTB | |
| | RTS | | |
| KYTBL | FCB | #$21 | D8 |
| | FCB | #$28 | D10 |
| | FCB | #$30 | D20 |
| | FCB | #$A0 | D100 |
| | FCB | #$05 | 0 |
| | FCB | #$0C | 1 |
| | FCB | #$14 | 2 |
| | FCB | #$84 | 3 |
| | FCB | #$03 | 4 |
| | FCB | #$0A | 5 |
| | FCB | #$12 | 6 |
| | FCB | #$82 | 7 |
| | FCB | #$41 | 8 |
| | FCB | #$48 | 9 |
| | FCB | #$50 | D |
| | FCB | #$C0 | = |

The following subroutine tests the key pressed. If the key was in the row (D8, D10, D20 or D100), it calls TOPROW. If it was a D it calls YESD. Otherwise it tests if we already have a D. If so, it calls DCSIDE. Otherwise NUMDC. It then returns.

```
SRTKEY  LDA   PRSKEY
        CMP   #$04     If key pressed was in the toprow
        BHS   PAD      call TOPROW then go to end
        JSR   TOPROW   else go on to next test
        BRA   ENDSRT
PAD     CMP   #$0E     If it's a D call YESD then goto end
        BNE   NOTD     else go on to next test
        JSR   YESD
        BRA   ENDSRT
NOTD    LDA   DFLAG    If we already have a D, this must
        CMP   #$01     be for the sides of the dice, so
        BEQ   HAVED    call DCSIDE. If we don't, it must be
        JSR   NUMDC    for the number of dice, call NUMDC
        BRA   ENDSRT
HAVED   JSR   DCSIDE
ENDSRT  RTS
```

The following subroutine is called when a D8, D10, D20 or D100 is pressed. It calls YESD (to print a D and ensure a NUMDI exists). It then puts the correct numbers in DSIDEs 1, 2, 3 and prints them. It flags FDATA as true and returns.

```
TOPROW  JSR   YESD     Call YESD to print a D, etc.
        LDA   PRSKEY   Was a D8 pressed?
        CMP   #$00
        BNE   NOTZER
        LDA   #$08     If not, put 8 into DSIDE1
        STA   DSIDE1
        BRA   WRITE    Was a D100 pressed?
NOTZER  CMP   #$03     If yes, put a 1 in DSIDE3
        BNE   NOT3
        LDA   #$01
        STA   DSIDE3
        STA   PNUM3
        BRA   WRITE
NOT3    STA   DSIDE2   Put a 1 Or 2 in DSIDE2
WRITE   LDA   DSIDE1
        STA   PNUM1
        LDA   DSIDE2
        STA   PNUM2
        LDA   DSIDE3
        STA   PNUM3
        JSR   PRNT3
        INC   FDATA    Set data flag true
        RTS
```

The following subroutine is called when a D is pressed on the keypad. It prints a D and sets the die sides to 0. It then checks for a positive NUMD1 and defaults to 1 if not found. Finally it sets the DFLAG positive and returns.

```
YESD    LDA   #$0D
        STA   PNUM4    Put a D in PNUM4
        CLRA
        STA   PNUM3    and clear the other PNUMs.
        STA   PNUM2    This causes d000 to be printed.
        STA   PNUM1
        STA   DSIDE1   Initialize DSIDES to zero. This ensures
        STA   DSIDE2   no unwanted numbers for DIESID.
        STA   DSIDE3
        JSR   PRNT4
        LDA   #$01     Make sure we have a NUMDIE
        CMP   NUMD1    by seeing if NUMD1 or NUMD2 has a
        BLS   HNUMD    number in it.
        CMP   NUMD2
        BLS   HNUMD    If no number is found for NUMDIE
        STA   NUMD1    put a 1 into NUMD1.
HNUMD   STA   DFLAG    Set Dflag positive.
        RTS
```

The following subroutine is called when the number of dice hasn't been determined yet. It checked for an equal sign and returns to PRTKEY if it finds one. Otherwise it moves NUMD1 to NUMD2 and puts PRSKEY into NUMD1. It then prints out the number.

```
NUMDC   LDA   PRSKEY   If PRSKEY is =, go to end
        CMP   #$0F
        BEQ   NUMEND
        LDA   NUMD1    Put NUMD1 into NUMD2
        STA   NUMD2
        STA   PNUM2
        JSR   MAKNUM   Get the number
        LDA   PNUM1    Put PRSKEY into NUMD1
        STA   NUMD1
        CLRA
        STA   PNUM3
        STA   PNUM4
        JSR   PRNT4    Print out new number
NUMEND  RTS
```

The following subroutine is called when the sides of the dice are being determined. It checks for an equal sign and if it finds one, it checks to make sure that DSIDES do exist. If not, it returns to the keypad, if yes it makes FDATA true and returns if it is not an equal sign. DSIDE1 is moved to DSIDE2, and the new number is put into DSIDE1. Both are printed.

```
DCSIDE  LDA   PRSKEY
        CMP   #$0F     If PRSKEY was an equal sign
```

-continued

```
        BEQ     EQSGN       go to EQSGN
        JSR     MAKNUM      Get decimal equivalent of PRSKEY
        LDA     DSIDE1      Move DSIDE1 to DSIDE2
        STA     DSIDE2
        STA     PNUM2       Ready to be printed
        LDA     PNUM1       Put new number into DSIDE1
        STA     DSIDE1
        JSR     PRNT2       Print out the number
        BRA     ENDDCS
EQSGN   CLRA
        CMP     DSIDE1      Test to see if we have a
        BNE     HAVDAT      valid number of die sides
        CMP     DSIDE2      If yes FDATA is true, otherwise
        BNE     HAVDAT      return to get more info
        BRA     ENDDCS
HAVDAT  INC     FDATA
ENDDCS  RTS
```

The following subroutine converts PRSKEY to the correct number and puts the result in PNUM1.

```
MAKNUM  LDA     PRSKEY
        SUB     #$04
        STA     PNUM1
        RTS
```

The following subroutine converts the sides of the dice contained in DSIDEs 1, 2, 3 to single binary equivalent in DIESID. It first checks DSIDE3 for a one. If it finds one, the D100 was called for. If not, CONVRT then adds ten for each value in DSIDE2 to the number in DSIDE1 and stores the result in DIESID. It then converts the numbers in NUMD1 and NUMD2 to a single variable called NUMDIE. Finally, CONVRT stores NUMDIE and DIESID in additional storage spaces called NUMDIC and DICSID.

```
CONVRT  CLRA
        STA     DIESID      Test to see if we have a D100
        CMP     DSIDE3      If so branch to DIE100
        BNE     DIE100
DC10    CMP     DSIDE2      Test to see if more then 9 sides
        BEQ     SMDIE       remain on the die.
        LDA     DIESID      Add ten to DIESID
        ADD     #$0A
        STA     DIESID
        DEC     DSIDE2      Subtract one from DSIDE2
        CLRA
        BRA     DC10        Check another time for sides
SMDIE   LDA     DIESID
        ADD     DSIDE1      Add DSIDE1 to DIESID
        STA     DIESID
        BRA     ENDCON
DIE100  LDA     #$64        Put 100 into DIESID
        STA     DIESID
        CLR     DSIDE3
ENDCON  CLR     DSIDE2
        CLR     DSIDE1
        LDA     #$00        This part of the subroutine
        STA     NUMDIE      converts the numbers in the NUMDs
NM2     CMP     NUMD2       to a single number called NUMDIE
        BEQ     NM1         First loop through NUMD2, adding
        LDA     NUMDIE      0A (10) to NUMDIE and subtracting
        ADD     #$0A        one from NUMD2 each time until
        STA     NUMDIE      NUMD2 is zero. Then add NUMD1 to
        DEC     NUMD2       NUMDIE
        LDA     #$00
        BRA     NM2
NM1     LDA     NUMDIE
        ADD     NUMD1
        STA     NUMDIE
        STA     NUMDIC      Store NUMDIE in NUMDIC
        LDA     DIESID      Store DIESID in DICSID
        STA     DICSID
        RTS
```

The following subroutine checks with PORTA (which is wired to the luck selector) until it finds a match. When a match is found, the corresponding luck factor is returned. From the hard wiring all the choices are wires high. The return is wired low and is bit 0 in PORTA. The selected luck factor will also be low but all others will be high. Thus the accumulataor is loaded with PORTA and comparisons are made until the zero is found. That will give us the luck factor.

```
GTLUCK  LDA     #$01        Initialize LUCK to one
        STA     LUCK
```

-continued

```
        LDA     PORTA     Load the luck selector reading
        LSRA              Get rid of the zero bit
STRTLK  LSRA              Move the next bit into carry
        BCC     ENDLCK    See if the carry bit is clear
        INC     LUCK      If no, try the next bit in PORTA
        BRA     STRTLK    If the carry was clear, the
ENDLCK  RTS               selector was pointing there.
```

Figure 4A:
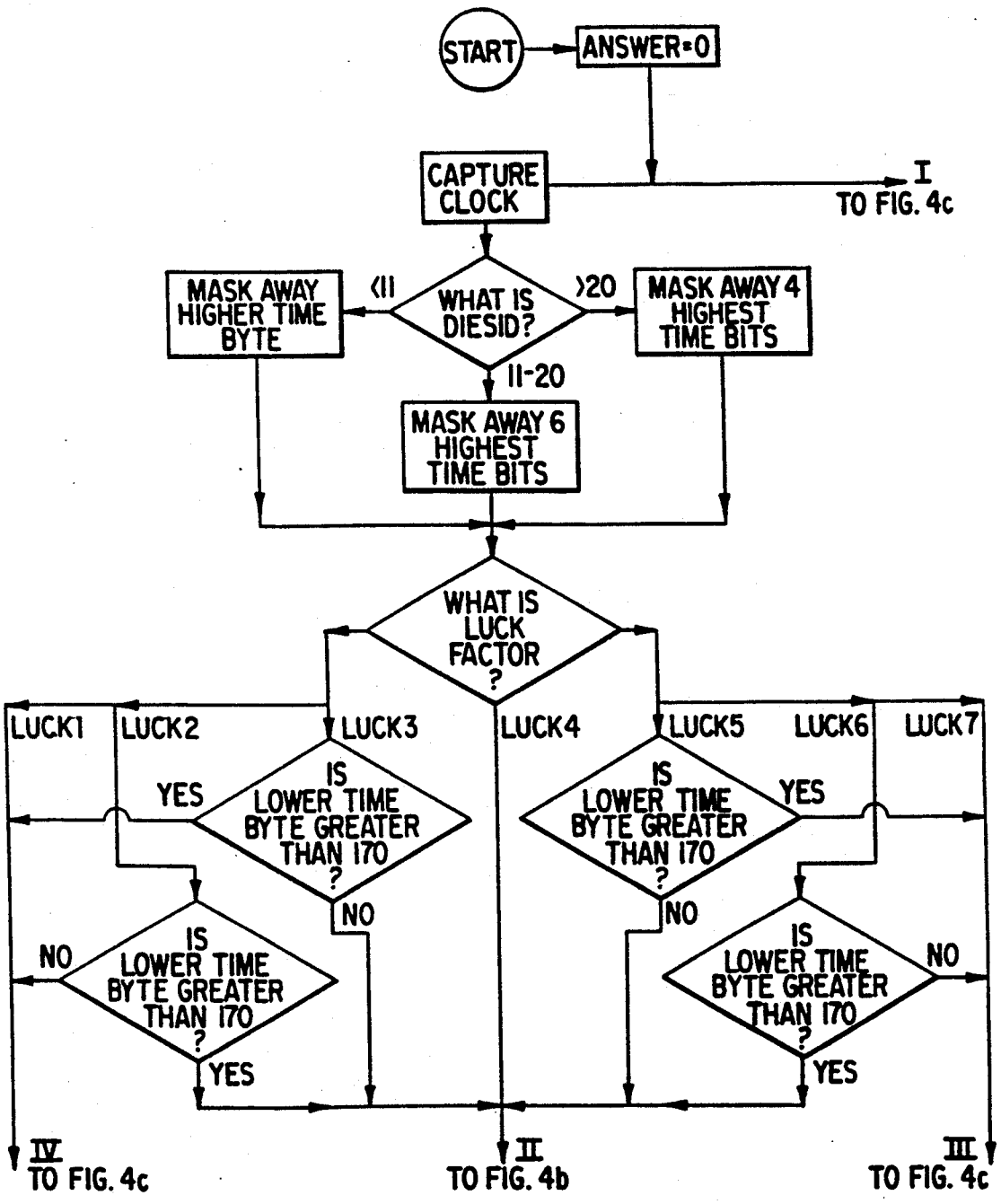
FIGS. 4*a*, 4*b* and 4*c* are the flowchart of the subroutine "ANSWER" in the flowchart of FIGS. 3*a* and 3*b*.
Figure 4B:
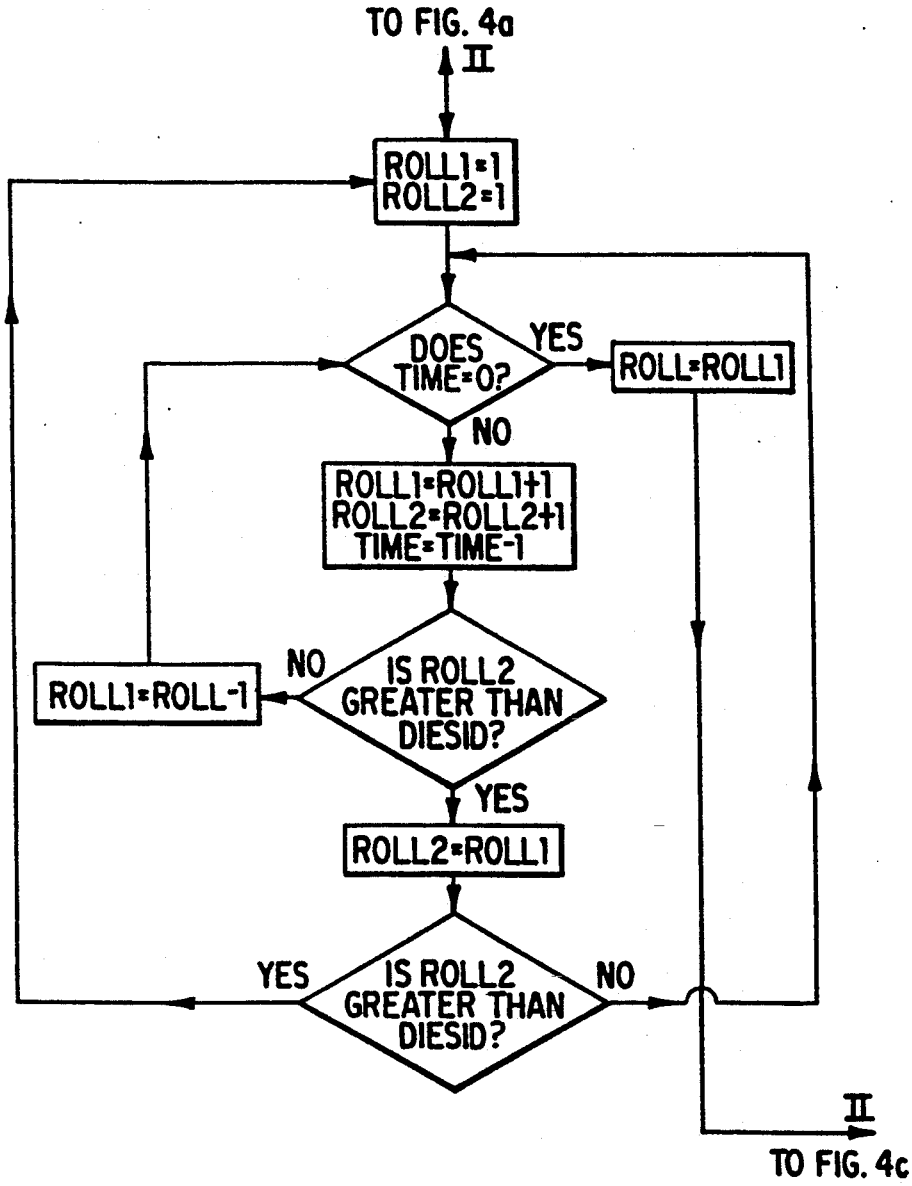
Figure 4C:
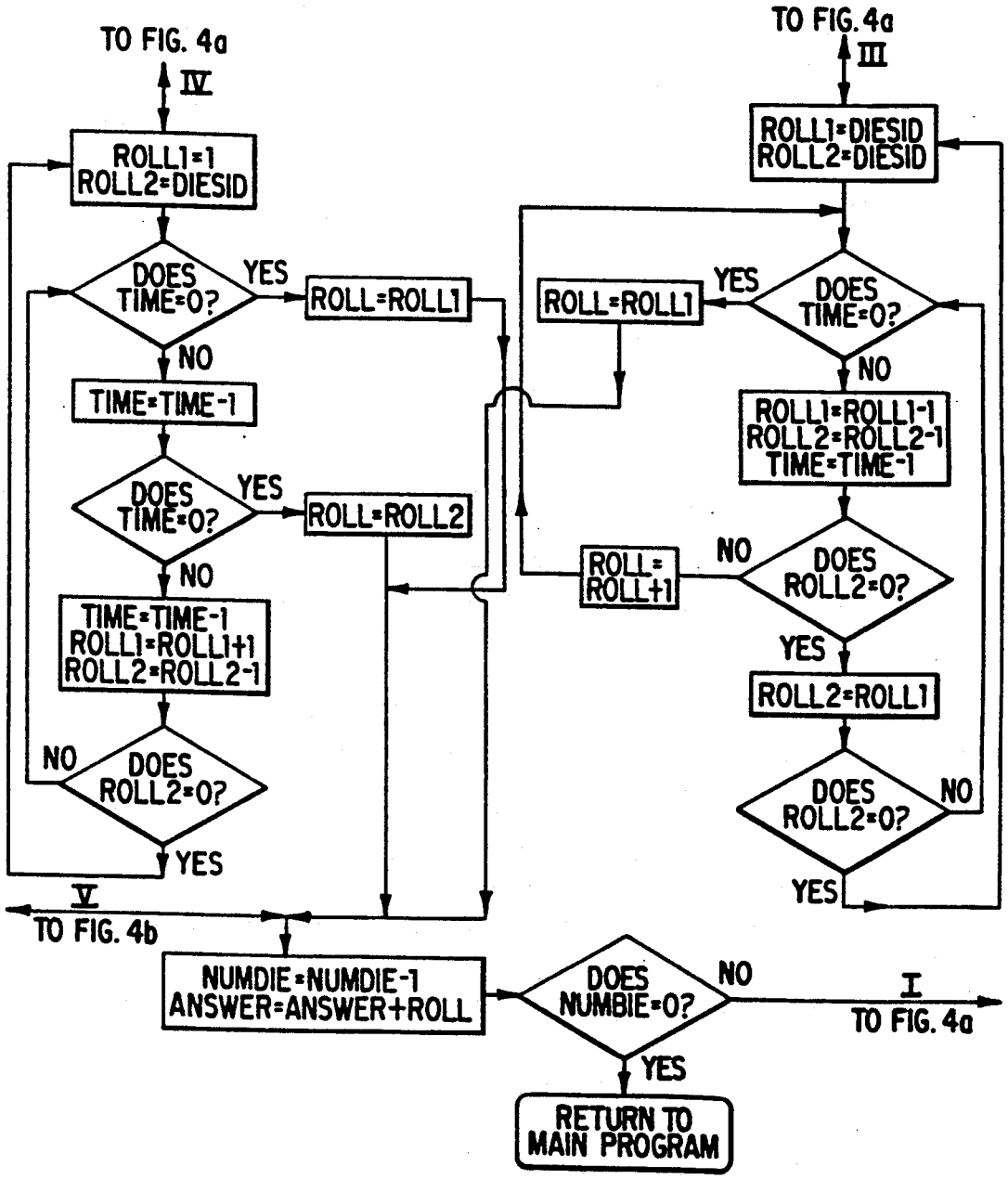

A major subroutine of the program is "GET ANSWER" which is invoked once the last block in FIG. 3*a* is reached. The subroutine "GET ANSWER" is shown in flowchart form in FIGS. 4*a*, 4*b* and 4*c*. The subroutine returns the answer that is the total of all the dice rolled, it gets the time, selects the correct luck program to call (receiving ROLL back) then adds ROLL to its previous total until all the dice have been counted. The sum is returned as TOTAL.

```
ANSWER  CLRA
        STA     TOTALL    Set totals (high and low)
        STA     TOTALH    to zero
STARTA  JSR     GTTIME    Get the time
        CLR     FOUND     Set FOUND false
        LDA     LUCK
        CMP     #$04
        BEQ     L4        In this section the LUCK factor
        CMP     #$01      is used to select the appropriate
        BEQ     L1        subroutine to find the ROLL.
        CMP     #$07
        BEQ     L7
        CMP     #$02
        BEQ     L
        CMP     #$03
        BEQ     L3
        CMP     #$05
        BEQ     L5
        JSR     LUCK6
        BRA     ENDA      After ROLL is returned, the
L1      JSR     LUCK1     subroutine jumps to ENDA.
        BRA     ENDA
L2      JSR     LUCK2
        BRA     ENDA
L3      JSR     LUCK3
        BRA     ENDA
L4      JSR     LUCK4
        BRA     ENDA
L5      JSR     LUCK5
        BRA     ENDA
L7      JSR     LUCK7
        BRA     ENDA
ENDA    LDA     TOTALL
        ADD     ROLL      Add ROLL to the lower byte
        STA     TOTALL    of total
        LDA     TOTALH    Add carry bit to Totalh - this
        ADC     #$00      allows numbers higher than 255
        STA     TOTALH
        DEC     NUMDIE    After each die is rolled, the
        CLRA              number of dice remaining is
        CMP     NUMDIE    checked. When that number is
        BEQ     ENDANS    zero, all the dice have been
        JMP     STARTA
ENDANS  RTS
```

The following subroutine collects, in the accumulator, the time from the internal clock and stores it in a high byte and low byte, in variables TIMEH and TIMEL, respectively. The variables TIMEH and TIMEL serve as a counter. It then masks part of the higher byte, depending on the die's number of sides. This is to ensure fast response time without sacrificing randomness.

```
GTTIME  LDA     $1A
        STA     TIMEH     Get the time and store it
        LDA     $1B
```

-continued

```
        STA     TIMEL
        LDA     DIESID    Test the die sides
        CMP     #$14      Is it more than 20?
        BHI     M3        If yes, branch to M3
        CMP     #$0A      Is it more than 10?
        BHI     M2        If yes go to M2
        LDA     TIMEH
        AND     #$03
        STA     TIMEH     For 10 or less sides TIMERH
        BRA     ENDTIM    uses only its 2 right-most bits
M2      LDA     TIMEH     For 11-20 sides, use four bits
        AND     #$0F      from TIMEH
        STA     TIMEH
        BRA     ENDTIM
M3      LDA     TIMEH     For more than 20 sides, use
        AND     #$3F      six bits of TIMEH
        STA     TIMEH
ENDTIM  RTS
```

The following subroutine scans the list of numbers between 1 and DIESID, from the top down and bottom up simultaneously. When TESTIM returns FOUND as true, the number currently being searched is the ROLL and is returned to ANSWER.

```
LUCK4   NOP
START4  LDA   DIESID   Initialize top down search
        STA   ROLL2
        CLR   ROLL1    Initialize bottom up search
BEGIN4  INC   ROLL1    ROLL1 gets next number on list
        JSR   TESTIM   Is the time up?
        CMP   FOUND    TESTIM always returns zero in
        BNE   A4       the accumulator. If Found is true
        JSR   TESTIM   the ROLL is decided, else try
        CMP   FOUND    the next number.
        BNE   B4
        DEC   ROLL2    ROLL2 goes to next number on its
        CMP   ROLL2    list. Does it = 0? (accumulator)
        BNE   BEGIN4   If no, go to BEGIN4
        BRA   START4   Else branch to START4
A4      LDA   ROLL1
        BRA   END4
B4      LDA   ROLL2
END4    STA   ROLL
        RTS
```

The following subroutine is heavily favoured to ROLL low numbers. It

```
creates a pattern   1 1 1 1 1 1 . . .   and searches through it
from top down.      2 2 2 2 2 . . .     When TESTIM returns a
positive FOUND      3 3 3 3 . . .       the number currently
under examination   4 4 4 . . .         is the ROLL which LUCK1
returns to          5 5 etc,.           ANSWER.
LUCK1   NOP
START1  CLR   ROLL     Initialize ROLL
        CLR   ROLL1    ROLL1 is a dummy variable
BEGIN1  INC   ROLL
        INC   ROLL1
        JSR   TESTIM   See if number is FOUND
        CMP   FOUND    (accumulator = 0 from TESTIM)
        BNE   END1     When Found go to end
        LDA   ROLL1    This section creates the pattern
        CMP   DIESID   Row one has DIESID 1's in it
        BEQ   NEXT1    Row 2 has (DIESID-1) 2's in it
        DEC   ROLL     This puts the correct number of
        BRA   BEGIN1   entries in each row
NEXT1   LDA   ROLL     This part prepares to start
        STA   ROLL1    the next row (which will have
        CMP   DIESID   one less entry than the previous
        BEQ   START1   one)
        BRA   BEGIN1
END1    RTS
```

The following subroutine is heavily favoured to ROLL high numbers. It

```
creates a pattern   1              and searches from bottom
up. When TESTIM     2 2            returns FOUND as true, the
number being        3 3 3          examined is returned to
ANSWER as the       4 4 4 4 etc,.  ROLL.
LUCK7   NOP
START7  LDA   DIESID   Initialze bottom up search
        STA   ROLL
        STA   ROLL1    Dummy variable
BEGIN7  CLRA
        CMP   ROLL1    This subroutine operates the same
        BEQ   NEXT7    as LUCK1 except that it runs
        JSR   TESTIM   through the large numbers first
        CMP   FOUND
        BNE   END7
        DEC   ROLL1
        BRA   BEGIN7
NEXT7   DEC   ROLL
        LDA   ROLL
        STA   ROLL1
        CMP   #$00
        BEQ   START7
        BRA   BEGIN7
```

-continued

```
END7    RTS
```

The following subroutine tests the value in the lower time byte. If the value is in the upper third, the value of ROLL returned to ANSWER will be from LUCK4, otherwise from LUCK1.

```
LUCK    LDA   TIMEL
        CMP   #$AA     AA = 170 which is two thirds of
        BHI   PRT2B    255
        JSR   LUCK1
        BRA   END2
PRT2B   JSR   LUCK4
END2    RTS
```

The following is the same as LUCK2 except that two thirds of the time ROLL will be from LUCK4 and one third from LUCK1.

```
        LUCK3   LDA   TIMEL
                CMP   #$AA
                BHI   PRT3B
                JSR   LUCK4
                BRA   END3
        PRT3B   JSR   LUCK1
        END3    RTS
```

The following subroutine is the same as LUCK2 except that two thirds of the time the ROLL will be from LUCK4 and one third LUCK7.

```
        LUCK5   LDA   TIMEL
                CMP   #$AA
                BHI   PRT5B
                JSR   LUCK4
                BRA   END5
        PRT5B   JSR   LUCK7
        END5    RTS
```

The following subroutine is the same as LUCK2 except that two thirds of the time the ROLL will be from LUCK7 and one third LUCK4.

```
        LUCK6   LDA   TIMEL
                CMP   #$AA
                BHI   PRT6B
                JSR   LUCK7
                BRA   END6
        PRT6B   JSR   LUCK4
        END6    RTS
```

The following subroutine's purpose is to test if time=0 and to flag FOUND as true when it is. If time doesn't equal zero, time is decreased by 1 and the subroutine returns to the calling program. Time is stored in TIMEL and TIMEH.

```
TESTIM  CLRA                   Test lower time byte
        CMP   TIMEL            If it's not zero, goto continue
        BNE   CONT1
        CMP   TIMEH            If it is, test higher byte
        BNE   CONT2            If it's not zero, go to cont2
        INC   FOUND            If it is, set FOUND as true
        BRA   ENDTT
CONT2   DEC   TIMEH
CONT1   DEC   TIMEL
ENDTT   LDA   #$00
```

-continued

```
        RTS
```

Now the "GET ANSWER" subroutine is finished and the program returns to the block "CONVERT ANSWER TO DECIMAL FORM" at the top of FIG. 3*b*. Thus, the following subroutine converts TOTALH and TOTALL to decimal form and readies it for printing. It does the lower byte by itself and calls BIGNUM if there is a value in TOTALH.

```
TODEC   CLR   PNUM4
        CLR   PNUM3    Set all the outputs to zero
        CLR   PNUM2
        CLR   PNUM1
        LDA   TOTALL   Sort out the hundreds first
DG100   CMP   #$64     When TOTALL is less than 100
        BLO   DG10     move on to the tens column
        SUB   #$64
        INC   PNUM3    PNUM3 has the 100's value
        BRA   DG100
DG10    CMP   #$0A     Is TOTALL now less than 10?
        BLO   DG1      When it is, move on to the ones
        SUB   #$0A
        INC   PNUM2    PNUM2 has the 10's value
        BRA   DG10
DG1     STA   PNUM1    The remainder is the ones value
        LDA   TOTALH   Test to see if TOTALH exists
        CMP   #$00     If it does then the total is
        BEQ   ENDTOD   above 255 and we call BIGNUM
        JSR   BIGNUM
ENDTOD
```

The following subroutine is called when the answer in total exceeds 255. It converts the number in TOTALH to decimal form and adds it to the numbers obtained from TOTALL. The result is stored in PNUM and is ready to be printed.

```
BIGNUM  NOP
STRTBG  LDA   PNUM3
        ADD   #$02
        STA   PNUM3
        LDA   PNUM2    This adds 256 to the PNUMs for
        ADD   #$05     each value in TOTALH.
        STA   PNUM2
        LDA   PNUM1
        ADD   #$06
        STA   PNUM1
        DEC   TOTALH
        CLRA
        CMP   TOTALH
        BNE   STRTBG
        LDA   PNUM1    This section makes sure that
BABNUM  CMP   #$09     PNUM1 contains nine or less
        BLS   TENSOR   with the excess converted to
        SUB   #$0A     PNUM2
        INC   PNUM2
        STA   PNUM1
        BRA   BABNUM
TENSOR  LDA   PNUM2    This section ensures that PNUM2
TENNUM  CMP   #$09     contains nine or less with the
        BLS   HUNOR    excess converted to PNUM3
        SUB   #$0A
        INC   PNUM3
        STA   PNUM2
        BRA   TENNUM
HUNOR   LDA   PNUM3    This section ensures that PNUM3
SENNUM  CMP   #$09     contains nine or less with the
        BLS   DONER    excess converted to PNUM4
        SUB   #$0A
        INC   PNUM4
        STA   PNUM3
        BRA   SENNUM
DONER   RTS
```

The following subroutine is called to initialize the PNUMs so that the word diCE is printed on the display.

```
PDICE   LDA   #$0D
        STA   PNUM4    This subroutine simply
        LDA   #$01     loads the PNUMs from the
        STA   PNUM3    accumulator, one at a time
        LDA   #$0C
        STA   PNUM2
        LDA   #$0E
        STA   PNUM1
        JSR   PRNT4
        RTS
```

The following subroutine displays the answer for 10 seconds, then changes the display to dice. If a key is pressed before the ten seconds expires, the loop is ended and the regular program is resumed at SRCHKY.

```
TMFRDC   LDA   #$0F
         STA   PNUM3
LOOP3    LDA   #$80
         STA   PNUM1     This subroutine creates a loop.
         DEC   PNUM3
LOOP2    LDA   #$FF      Every time through its inner loop,
         STA   PNUM2     it checks to see if anything has
         DEC   PNUM1
LOOP1    LDA   PORTB     been hit on the keypad. If it has
         CMP   #$99      the subroutine kicks out.
         BNE   DICEND
         DEC   PNUM2
         CLRA
         CMP   PNUM2
         BNE   LOOP1
         CMP   PNUM1
         BNE   LOOP2
         CMP   PNUM3
         BNE   LOOP3
DICEND   RTS
```

The following is the subroutine that prints out at the LCD. Calling a PRNT program also calls those beneath it.

```
PRINT4   LDA   PNUM4     Load the accumulator with PNUM4 and
         STA   PORTC     send to the output file
         LDA   #$10      This is the switch that causes the
         STA   PORTC     output file to be printed
         JSR   PRNT3     Now call PRNT3
         RTS             Return to calling program
PRNT3    LDA   PNUM3     This is the same as PRNT4 except
         ADD   #$40      that PNUM3 is printed
         STA   PORTC     The #$40 must be added to PNUM3 so
         LDA   #$10      the LCD will know the digit that
         STA   PORTC     PNUM3 gets printed in.
         JSR   PRNT2
         RTS
PRNT2    LDA   PNUM2
         ADD   #$80
         STA   PORTC
         LDA   #$10
         STA   PORTC
         JSR   PRNT1
         RTS
PRNT1    LDA   PNUM1
         ADD   #$C0
         STA   PORTC
         LDA   #$10
         STA   PORTC
         RTS
```

In operation, the program begins by searching the keypad to detect the number of dice selected (from 1 to 99); the number of sides on each die (from 1 to 100); and the probability weighting factor.

For example, by setting the dial 15 at "4" and pressing from among the "dice-type" buttons the button 18*a* (D8) the operator selects a single, eight sided, evenly weighted die having "sides" numbered "1" to "8".

In general, to determine the number of dice the operator presses numerical buttons 12*a* to 12*j* corresponding to the desired number of dice (1 to 99); the default is one die. For die other than those provided by pressing the buttons 18 for the pre-selected types (8 sided. 10 sided. 20 sided and 100 sided) the operator then presses the "D" button 16 and then presses numerical buttons 12*a* to 12*j* corresponding to the desired number of sides (1 to 100); otherwise the operator does not press the "D" button 16 and just presses the desired "dice-type" button 18. Subsequently pressing the "=" button 17 would start the simulation. Therefore, before pressing the "=" button 17 the desired probability weighting should be selected using the dial 15.

Pressing the "=" button 17 indicates to the device that the operator is ready to "roll", provided the device has received sufficient information. If it has received enough information, pressing the "=" button 17 causes the device to convert the numerical input from base 10 form to binary form. The position of the dial 15 of the probability weighting selector 20 then determines the weighting of the die or dice, and that weighting is recorded.

Due to the fact that the microprocessor 19 is running at high clock rate, say, 2 MHz, it is difficult for human operators to determine, without the aid of electronics, what clock value will be recorded by pressing the "=" button 17 on the key pad 22. Therefore, it is in this sense that the disc simulator 10 is a random/pseudo-random device.

The count on the internal clock of the microprocessor 19 is recorded by pushing the "=" key 17 of key pad 22. The microprocessor 19 clock has an 8 bit higher time register and an 8 bit lower time register. It is preferred to mask some of the higher bits in the clock count, to decrease the response time of the device 10. The number of higher bits masked is masked is proportional to the number of sides on each die. Thus if a 20 sided die were rolled, there would be 1024 different numbers that would actually be used to determine the number rolled.

The number 1024 is obtained because the six left-most bits of the higher time register are masked away. This leaves the entire lower time register which has eight bits and the two remaining bits from the higher time register, for a total of ten bits. Each bit may be zero or one. Therefore, there are 1024 different combinations possible (2 to the exponent ten).

If a 100 sided die were to be rolled, then there are 0.096 possible readings since only the four left-most bits of the higher time register are masked away.

If the probability weighting dial 15 is set to position 4, i.e. the middle position, there is for an ordinary unaided operator an even chance of any number between 1 and the number of sides of the die being "rolled". A number is "rolled " in that instance by the device 10 iteratively comparing the recorded clock count to a lower value and to that upper value. First, if the recorded clock count is "zero" then the value "1" has been "rolled". If that clock count is not "zero" then the clock count is compared to the upper value (at this stage, the number of sides of the die). If the clock count is that upper value then that upper value is "rolled". If the clock count is not that upper value then the lower value is increased by one and the upper value is decreased by one. The new upper and lower values are once again compared to the recorded clock count. The comparisons and iterations continue until (i) the lower value and the recorded clock count equal or (ii) the "upper value" has been iterated down to zero. Once that "upper value" has been iterated to zero (i) it is reassigned the value of the number of sides of the die and (ii) the lower value is reassigned the value "1".

The possibility of repeated comparisons and resettings, ad infinitum, is precluded as follows. After each comparison the recorded clock count is compared to zero. If the clock count is zero then the device indicates the value is "rolled". If the recorded clock count is not zero that count is decreased by one and the next iteration and comparison begin.

The probability weighting dial 15 may alternatively be set to any one of positions 1, 2 or 3, position 1 being the most weighted towards producing low number "rolls", position 3 being the least weighted towards producing low number "rolls" and position 2 being intermediately weighted between positions 1 and 3.

In position 1 the "upper value" is used as a counter rather than as a possible "roll". That is done by the "upper value" and "lower value" initially being given the value "1". The recorded clock count is then compared to the upper and lower value. If the recorded clock count does not match that value then the upper value is increased by one. Such comparisons and increases continue until the upper value equals the selected number of sides on the die. Once that equality occurs the lower value is increased by one and the upper value becomes the same as that new lower value. The comparisons and increases continue as in the initial round on the setting, until the lower value equals the selected number of sides on the die. Once that equality occurs the upper and lower values are again set at "1" and the process continues until the recorded clock count matches either the upper value or the lower value.

The "rolls" at settings "2" and "3" are obtained by examining the lower time register of the internal clock of the microprocessor 19. The lower time register of the microprocessor 19 has 8 bits in it and so can have 256 (i.e. 2 to the exponent 8) different values, from 1 to 256. The number 170 is approximately $\frac{2}{3}$ of 256. If the value on the lower time register is greater than 170 then the simulated roll is arrived at by the procedure used at setting 4. Therefore if the device 10 is set to position 2 of the probability weighting dial 15 then two thirds of the generated numbers will be arrived at by the procedure used at setting 1 ("Luck 1" in FIG. 4*a*) and one third of the generated numbers will be arrived at by the procedure used at setting 4 ("Luck 4" in FIG. 4*a*). Conversely if the device is set to position 3 then the respective splits are $\frac{1}{3}$ and $\frac{2}{3}$ rather than $\frac{2}{3}$ and $\frac{1}{3}$.

Settings 5 to 7 of the probability weighting dial 15 weight the device towards producing high "rolls". They do so in a manner analogous to the weighting provided by settings 1, 2 and 3 i.e. by using the upper value as a counter. However, at setting 7 of the dial 15 the upper and lower values are not initially set at 1 but rather at the value that is the number of sides of the die. The iterations result in the upper value being decreased by one each time, until it equals zero; the lower value is then reduced by one and the lower value becomes the new upper value. Such iterations occur until the lower value equals zero. Upon that event the upper and lower values are reset to the value that is the number of sides on the die and the comparisons and iterations start over.

The "rolls" at settings "5" and "6" are obtained by examining the lower time register of the internal clock of the microprocessor 19. When the value in the lower time register is less than or equal to 170 the roll will be simulated in accordance with the procedure at setting "4". When the value in the lower time register is greater than 170 the roll will be simulated in accordance with the procedure at setting "7". Therefore, if the device 10 is set to position 5 of the probability weighting dial 15 then two thirds of the generated numbers will be arrived at by the procedure used at setting 4 and one third of the generated numbers will be arrived at by the procedure used at setting 7. Conversely, if the device is set to position 6 then the respective splits are $\frac{1}{3}$ and $\frac{2}{3}$ rather than $\frac{2}{3}$ and $\frac{1}{3}$.

As the "rolls" for each die are produced they are summed. The device then converts the sum to the base 10 system and displays on screens 13 and 14 the final sum of the individual die rolls comprising that simulation.

After 10 seconds of display of the simulation result the device is re-initialized and enters a low power mode to conserve the power supply 30. It remains in that mode until a key on the key pad 22 is pressed. If the key is the "=" button 17, the device generates and displays a simulation, using the same variables (i.e. number of die, number of sides per die and probability weighting) as in the previous roll as many times as that button is pressed, until the device is turned off. If before pressing the "=" button 17 the position of the dial 15 is changed no other variables, by that act alone, are changed. If before pressing the "=" button 17 one or more of the numerical key pad buttons 12*a*–12*j* are pressed the device generates and displays a simulation based on the previously set number of sides per die and probability weighting and on the newly set number of die.

It will be apparent to those skilled in the art that various modifications can be made to the apparatus and method for simulating dice rolling and the like of the instant invention without departing from the scope or spirit of the invention, and it is intended that the present invention cover modifications and variations of the apparatus and method for simulating dice rolling and the like provided they come within the scope of the appended claims and their equivalents. Further, it is intended that the present invention cover present and new applications of the apparatus and method of the present invention.

What is claimed is:

1. Apparatus for simulating dice rolling and the like, comprising:

first data entry means for entering numerical selection data;

microprocessor means for processing said numerical selection data and for computing simulation results corresponding to the numerical selection data, said microprocessor means including:

processing means for processing said numerical selection data;

an internal clock for generating a count;

a counter, coupled to said internal clock, responsive to the entering of said numerical selection data, for recording the count of said internal clock in said counter;

generating means for generating quasi-random numbers as simulation results using the count in said counter corresponding to said numerical selection data;

second data entry means for entering probability weighting criteria to bias said computing of simulation results using the recording of the count of the internal clock, and to cause the processing of the numerical selection data to yield the simulation results in accord with said probability weighting criteria.

2. The apparatus as set forth in claim 1, further comprising:

first display means for displaying the simulation results to a user.

3. The apparatus as set forth in claim 2 wherein the microprocessor means includes a Motorola MC68HC705 integrated circuit.

4. The apparatus as set forth in claim 3 wherein the first display means includes an Intersil 7211 LCD driver.

5. The apparatus as set forth in claim 3 wherein the first display means includes an Intersil 7211M LCD driver.

6. The apparatus as set forth in claim 2, further comprising:

second display means for displaying the simulation results in an opposite direction of view from a user.

7. Apparatus for simulating dice rolling and the like, comprising:

first data entry means for entering numerical selection data;

second data entry means for entering bias data;

timing means for generating a reference timing signal; and microprocessor means, coupled to said timing means, coupled to said first data entry means, coupled to said second data entry means, said microprocessor means including:

at least one memory, responsive to said first data entry means, for storing the reference timing signal as a stored timing signal;

at least one register, coupled to the at least one memory, responsive to said first data entry means, for loading the stored timing signal as a count, and for masking a set of most significant bits of the count as a masked timing signal; and at least one arithmetic-logic unit, coupled to the at least one register, responsive to said first data entry means, responsive to said second data entry means, for generating an upper value and a lower value from the masked timing signal, for iteratively comparing the upper value and the lower value, respectively, with the masked timing signal, and for iteratively changing the upper value and the lower value, respectively, according to a predetermined computer algorithm using the bias data to generate quasi-random numbers as simulation results.

8. The apparatus as set forth in claim 7, further comprising:

first display means for displaying the simulation results to a user.

9. The apparatus as set forth in claim 8, further comprising:

second display means for displaying the simulation results in an opposite direction of view from a user.

10. A method, using an apparatus having a clock, a keypad, a selector, and a microprocessor, the microprocessor having a plurality of registers, for simulating dice rolling and the like, comprising the steps of:

generating a reference timing signal using a clock;

inputting numerical selection data using a keypad;

inputting bias data using a selector;

storing the reference timing signal in a first register as a stored timing signal;

masking a set of most significant bits of the stored timing signal in the first register as a masked timing signal in the first register;

generating an upper value in a second register and a lower value in a third register from the masked timing in the first register;

comparing, iteratively, the upper value in the second register and the lower value in the third register with the masked timing in the first register;

changing, iteratively, the upper value in the second register and the lower value in the third register according to a predetermined computer algorithm using the bias data;

halting the iterations of the step of comparing the upper values in the second register and the lower values in the third register and the iterations of the step of changing the upper values in the second register and the lower values in the third register, according to the predetermined computer algorithm; and generating quasi-random numbers as simulation results using the second register and the third register.

11. The method as set forth in claim 10, further comprising the step of:

displaying the simulation results to a user on a liquid crystal diode (LCD) display.

12. The method as set forth in claim 11, wherein the step of displaying includes displaying the simulation results in decimal format.

13. The method as set forth in claim 12, further comprising the step of initializing the microprocessor.

14. The method as set forth in claim 13 wherein the predetermined computer algorithm is written in Motorola Assembly Language.

* * * * *